US008188426B2

(12) United States Patent
Mukaibatake

(10) Patent No.: US 8,188,426 B2
(45) Date of Patent: May 29, 2012

(54) QUADROPOLE MASS SPECTROMETER

(75) Inventor: Kazuo Mukaibatake, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 12/993,246

(22) PCT Filed: May 22, 2008

(86) PCT No.: PCT/JP2008/001282

§ 371 (c)(1),
(2), (4) Date: Nov. 17, 2010

(87) PCT Pub. No.: WO2009/141852

PCT Pub. Date: Nov. 26, 2009

(65) Prior Publication Data

US 2011/0062325 A1 Mar. 17, 2011

(51) Int. Cl.
*H01J 49/42* (2006.01)

(52) U.S. Cl. ..... 250/292

(58) Field of Classification Search ..... 250/292, 250/290, 281

See application file for complete search history.

(56) References Cited

U.S. PATENT DOCUMENTS

| | | | | |
|---|---|---|---|---|
| 3,784,814 | A | 1/1974 | Sakai et al. | |
| 4,535,236 | A | 8/1985 | Batey | |
| 5,623,144 | A | 4/1997 | Yoshinari et al. | 250/281 |
| 6,153,880 | A * | 11/2000 | Russ et al. | 250/292 |
| 6,191,417 | B1 * | 2/2001 | Douglas et al. | 250/282 |
| 6,340,814 | B1 * | 1/2002 | Vandermey | 250/292 |
| 7,045,797 | B2 * | 5/2006 | Sudakov et al. | 250/292 |
| 7,078,686 | B2 | 7/2006 | Roushall et al. | 250/292 |
| 2002/0005480 | A1 | 1/2002 | Harada | 250/288 |
| 2006/0016985 | A1 | 1/2006 | Roushall et al. | 250/292 |
| 2010/0193684 | A1 | 8/2010 | Mukaibatake et al. | |

FOREIGN PATENT DOCUMENTS

JP 02-94242 4/1990

(Continued)

OTHER PUBLICATIONS

Translation of International Preliminary Report on Patentability and Written Opinion of the International Searching Authority, Jan. 11, 2011.

Chinese language office action dated Dec. 15, 2011 and its English language translation for corresponding Chinese application 200880129385.4.

(Continued)

*Primary Examiner* — Kiet T Nguyen

(74) *Attorney, Agent, or Firm* — DLA Piper LLP (US)

(57) ABSTRACT

If a scanning rate of a mass scanning is set to be high, the amount of change in an applied voltage between a time of an incidence of a certain ion into a quadrupole mass filter and a time of an emission of the ion therefrom increases. This leads to a change in the condition of a passage of ions, causing the amount of ions to decrease and thereby deteriorating detection sensitivity. In order to avoid this problem, according to the present invention, the values of direct current voltage U and an amplitude V of radio-frequency voltage, both voltages being applied to rod electrodes during a mass scanning, are respectively determined so that a voltage ratio U/V of the voltage U to the amplitude V becomes smaller as the scanning rate becomes higher. Accordingly, in a stability diagram based on the Mathieu equation, the inclination of line L indicating the change in the applied voltage during the mass scanning becomes gradual and the amount of ions passing through the quadrupole mass filter increases particularly when the mass is high.

14 Claims, 6 Drawing Sheets

FOREIGN PATENT DOCUMENTS

| | | | |
|---|---|---|---|
| JP | 08-102283 | | 4/1996 |
| JP | 08-287866 | | 11/1996 |
| JP | 2002-025498 | | 1/2002 |
| JP | 2005-259616 | | 9/2005 |
| JP | 2006-040890 | | 2/2006 |
| JP | 2008-052996 | | 3/2008 |
| WO | 2007083403 | A1 | 7/2007 |

OTHER PUBLICATIONS

Sandra et al., "The Q-Trap Mass Spectrometer, a Novel Tool in the Study of Protein Glycosylation" Journal of the American Society for Mass Spectrometry, vol. 15, pp. 413-423, 2004.

Extended European search report dated Dec. 6, 2011 for corresponding European application 08751794.2.

* cited by examiner (a) PRIOR ART: VOLTAGE RATIO U/V MAINTAINED CONSTANT (b) PRESENT INVENTION: VOLTAGE RATIO U/V CHANGED (c) PRESENT INVENTION: OFFSET CHANGED (a) PRESENT INVENTION (b) PRIOR ART

QUADROPOLE MASS SPECTROMETER

CROSS-REFERENCE TO THE RELATED APPLICATIONS

This application is a national stage of international application No. PCT/JP2008/001282, filed on May 22, 2008, the entire contents of which are incorporated herein by reference.

TECHNICAL FIELD

The present invention relates to a quadrupole mass spectrometer using a quadrupole mass filter as a mass analyzer which separates ions depending on their mass (m/z, in the precise sense).

BACKGROUND ART

As one type of mass spectrometers, a quadrupole mass spectrometer has been known in which a quadrupole mass filter is used as a mass analyzer which separates ions depending on their mass. FIG. 6 is a schematic configuration diagram of a typical quadrupole mass spectrometer, which mainly shows an ion optical system of the mass spectrometer.

A sample molecule is ionized in an ion source 1. Generated ions are converged (also accelerated in some cases) by an ion transport optical system 2, such as an ion lens, and introduced into a space in the longitudinal axis direction of a quadrupole mass filter 3. The quadrupole mass filter 3 includes four rod electrodes arranged in such positions as to be parallel to one another around an ion optical axis C (In FIG. 6, only two electrodes are shown). Voltages obtained by adding direct-current voltages±U and radio-frequency voltages±V·cos ωt are applied to those rod electrodes, respectively. Depending on the applied voltages, only the ions having a specified mass selectively pass through the space in the longitudinal axis direction of the quadrupole mass filter 3 whereas other ions are diffused along the way. A detector 4 outputs an electrical signal corresponding to the amount of ions having passed through the quadrupole mass filter 3.

As mentioned previously, the mass of ions passing through the quadrupole mass filter 3 varies depending on the voltages applied to the rod electrodes. Accordingly, the mass of ions arriving at the detector 4 can be scanned over a predetermined mass range by changing the applied voltages. This is a scanning measurement in a quadrupole mass spectrometer. In the case of a gas chromatograph/mass spectrometer (GC/MS) or a liquid chromatograph/mass spectrometer (LC/MS), for example, where the components of a sample introduced in the mass spectrometer change with time, various components that sequentially appear can be detected almost continuously by repeating the scanning measurement. FIG. 7 schematically shows a change in the mass of ions arriving at the detector 4 while the scanning measurement is repeated.

In such a scanning measurement, an increase in the scanning rate, i.e. the amount of change in the mass per unit time, shortens the time required for a single mass-scanning cycle. This means that the frequency of the scanning measurement implemented in a certain predetermined time can be increased in the repetitive scanning measurement. Accordingly, in GC/MS or LC/MS, time resolution is improved as the scanning rate is increased, thereby avoiding a failure in the detection of a component which appears only for a short time. Furthermore, in these days, many efforts have been made to speed up the component separation in an LC, for example, in order to improve the throughput of an analysis. On such occasion, it is important to improve the time resolution of mass spectrometry. For this reason, a further increase in the scanning rate is presently required.

However, the increase in the scanning rate causes the following problems: Consider the case where the necessary time for a certain ion to pass through the space in the longitudinal axis direction of the quadrupole mass filter 3 is "t". The necessary time t depends on the kinetic energy of each ion at the time when the ions arrive at the entrance of the quadrupole mass filter 3. FIG. 8 shows a relationship between time and voltage applied to the quadrupole mass filter 3. During the scanning measurement, the voltage applied to the quadrupole mass filter 3 is scanned so that it continuously changes. Accordingly, as shown in FIG. 8, the applied voltage changes even during a period of time when a certain ion is passing through the space in the longitudinal axis direction of the quadrupole mass filter 3. The higher the scanning rate is, the larger the amount of change ΔV in the applied voltage within the time t is.

The aforementioned change in the applied voltage means that the condition under which a certain ion passes through the quadrupole mass filter 3 (the mass of the ion passable therethrough) changes while the certain ion is passing therethrough. If the scanning rate is sufficiently low and the amount of voltage change ΔV is negligibly small, the aforementioned problem does not substantially occur. However, if the amount of voltage change ΔV is non-negligibly increased by increasing the scanning rate, there is the possibility that a part of the target ions cannot pass through the quadrupole mass filter 3. This causes a decrease in the amount of ions arriving at the detector 4, thereby deteriorating the detection sensitivity.

FIG. 9 shows a mass spectrum measured with a conventional quadrupole mass spectrometer. The upper row shows a mass spectrum obtained when the scanning rate was set at 125 [Da/sec], while the lower row shows a mass spectrum obtained when the scanning rate was set at 7500 [Da/sec]. In either row, the respective peak points are located at the mass of m/z 168.10, 256.15, 344.20, 520.35, 740.45, 872.55, 1048.65 and 1268.75, starting from the left of FIG. 9. It can be understood that the higher the scanning rate is, the narrower a peak width is, which means that the mass resolution is higher. On the other hand, it can also be understood that the higher the scanning rate is, the lower a peak height is, which means that the detection sensitivity is lower. This phenomenon is particularly remarkable when the mass is high.

In order to cope with the previously described problems, in the mass spectrometer disclosed in Patent Document 1, a bias voltage, which is applied to the respective rod electrodes of the quadrupole mass filter 3 separately from the voltages applied for ion separation, is changed so as to diminish the influence of the change in the scanning voltage on the ions passing through the quadrupole mass filter 3. If the bias voltage is changed, the kinetic energy of ions introduced into the quadrupole filter 3 varies. Accordingly, when the scanning rate is high, the bias voltage is changed in such a manner that the kinetic energy of ions introduced into the quadrupole mass filter 3 is increased. By this method, when the scanning rate is high, the passing time t of the ions becomes relatively short, making the amount of voltage change ΔV be relatively small and thereby avoiding deterioration in the detection sensitivity.

Patent Document 1: Japanese Unexamined Patent Application Publication No. 2002-25498

Patent Document 2: Japanese Unexamined Patent Application Publication No. H8-102283

Patent Document 3: Japanese Unexamined Patent Application Publication No. 2005-259616

DISCLOSURE OF THE INVENTION

Problem to be Solved by the Invention

Although the conventional technique disclosed in Patent Document 1 is an efficient method, it is required these days for a scanning rate to be increased more than ever before, and the method in some cases does not satisfactorily work for such recent demands. The present invention has been made in view of such problems, and an object of the present invention is to provide a quadrupole mass spectrometer capable of preventing detection sensitivity from being deteriorated even when the scanning rate is increased, thereby achieving high analytical sensitivity and analytical accuracy.

Means for Solving the Problems

In the case where a mass scanning (scanning measurement) is conducted in a quadrupole mass spectrometer, a voltage ratio U/V of direct current voltage U to an amplitude V of radio-frequency voltage V·cos ωt (hereinafter, called "voltage V" or "radio-frequency voltage V"), both applied to the respective electrodes forming the quadrupole mass filter, has been heretofore generally kept constant while each of the voltages U and V has been independently changed. The voltage ratio has been a fixed value regardless of the scanning rate. The following is the description in association with a stability diagram based on a stability condition of a solution to a Mathieu equation that is frequently used for explaining ion's behavior in a quadrupolar electrical field (see Patent Documents 2 and 3). The stability region in which ions can stably exist (i.e. where ions are not diffused) in the quadrupolar electrical field is shaped in an approximate triangle, as shown in FIG. 2(*a*). During the mass scanning, the stability region shifts as shown in FIG. 2(*a*) as the mass changes as indicated by M1, M2, and M3. Accordingly, the mass of the ions passing through the quadrupole mass filter can be scanned by changing the voltages U and V as shown with line L in FIG. 2(*a*). Since the voltage ratio U/V is kept constant, line L becomes a straight line. Meanwhile, the value of the voltage ratio U/V, the inclination and position of line L, stays constant, regardless of the scanning rate.

When the combination between the voltages U and V is found in the stability region, ions stably pass through the quadrupolar electric field. In addition, in the mass scanning, the amount of ions which have a certain mass and pass through a filter corresponds to the area upper from line L in the stability region for the mass concerned (i.e. the regions shown with hatched lines in FIG. 2(*a*)). Accordingly, in order to increase detection sensitivity by increasing the amount of ions passing through the quadrupolar electric field, the areas shown with the hatched lines in FIG. 2(*a*) may be enlarged. Based on this idea, in a quadrupole mass spectrometer according to the present invention, a length of line L crossing across the stability region is increased particularly at relatively high masses by changing the inclination of line L depending on the scanning rate, or by shifting the vertical position of line L depending on the scanning rate, in the stability diagram during the mass scanning, thereby allowing the stability region to be enlarged. The former one, i.e., changing the inclination of line L, is realized by changing, the voltage ratio U/V of the direct current voltage U to the radio-frequency voltage V. The latter one, i.e., shifting the vertical position of line L, is realized by changing an offset amount of the direct current voltage U (or the amplitude V of the radio-frequency voltage).

Specifically, according to a first aspect of the present invention made for solving the previously described problems, a quadrupole mass spectrometer includes: an ion source for ionizing a sample molecule; a quadrupole mass filter selectively allowing an ion having a specific mass to pass therethrough among ions generated in the ion source; and a detector for detecting ions having passed through the quadrupole mass filter, the quadrupole mass spectrometer comprising: a) a quadrupole driving means for applying, to respective electrodes forming the quadrupole mass filter, a voltage obtained by adding a direct current voltage and a radio-frequency voltage; and b) a control means for controlling the quadrupole driving means to sequentially change the direct current voltage and an amplitude of the radio-frequency voltage depending on the mass, and to change a ratio of the direct-current voltage to the amplitude of the radio-frequency voltage depending on a scanning rate, when a mass scanning is conducted in such a manner that the mass of ions passing through the quadrupole mass filter is sequentially changed.

In the quadrupole mass spectrometer according to the first aspect of the present invention, the control means relatively reduces the voltage ratio U/V of the direct current voltage U and the amplitude V of the radio-frequency voltage for a relatively high scanning rate. Accordingly, the inclination of line L depicted on a stability diagram during the mass scanning becomes more gradual, as shown in FIG. 2(*b*). As a result, at particularly high masses within the mass-scan range, the length of line L crossing across the stability region becomes longer, and the area enclosed by line L and the boundary line of the stability region becomes larger. In other words, the amount of ions passing through the quadrupole mass filter increases.

According to a second aspect of the present invention made for solving the previously described problems, a quadrupole mass spectrometer includes: an ion source for ionizing a sample molecule; a quadrupole mass filter selectively allowing an ion having a specific mass to pass therethrough among ions generated in the ion source; and a detector for detecting ions having passed through the quadrupole mass filter; the quadrupole mass spectrometer comprising: a) a quadrupole driving means for applying, to respective electrodes forming the quadrupole mass filter, a voltage obtained by adding a direct current voltage and a radio-frequency voltage; and b) a control means for controlling the quadrupole driving means to sequentially change the direct current voltage and an amplitude of the radio-frequency voltage depending on the mass, and to change an offset of the direct-current voltage depending on a scanning rate, when a mass scanning is conducted in such a manner that the mass of ions passing through the quadrupole mass filter is sequentially changed.

In the quadrupole mass spectrometer according to the second aspect of the present invention, the control means relatively reduces the offset of the direct current voltage U for a relatively high scanning rate. Accordingly, the entirety of the inclined line L depicted in the stability diagram during the mass scanning totally shifts downward in a parallel fashion, as shown in FIG. 2(*c*). As a result, the length of line L crossing across the stability region becomes longer in an overall range of the mass scanning, and the area enclosed by line L and the boundary line of the stability region becomes larger. In other words, the amount of ions passing through the quadrupole mass filter increases.

It should be noted that only one of the controls characteristic of the first and second aspects of the present invention may be conducted, or both may be conducted concurrently.

In the first and second aspects of the present invention, while the mass scanning is conducted over a predetermined mass range, the voltage ratio of the direct current voltage U and the radio-frequency voltage V is kept constant and does not vary along the way. Therefore, line L on the stability diagram is a straight line, and thus, only the inclination or the position of the line changes depending on a designated scanning rate. On the other hand, in order to further increase the amount of ions passing through the quadrupole mass filter in a region where the mass is relatively high, the voltage ratio of the direct current voltage to the radio-frequency voltage or the offset amount of the direct current voltage may be changed during a single mass-scanning cycle.

Accordingly, a third aspect of the present invention made for solving the above problems provides a quadrupole mass spectrometer including: an ion source for ionizing a sample molecule; a quadrupole mass filter selectively allowing an ion having a specific mass to pass therethrough among ions generated in the ion source; and a detector for detecting ions having passed through the quadrupole mass filter, the quadrupole mass spectrometer comprising: a) a quadrupole driving means for applying, to respective electrodes forming the quadrupole mass filter, a voltage obtained by adding a direct current voltage and a radio-frequency voltage; and b) a control means for controlling the quadrupole driving means to sequentially change the direct current voltage and an amplitude of the radio-frequency voltage depending on the mass, and to change a ratio of the direct current voltage to an amplitude of the radio-frequency voltage depending on the mass, when a mass scanning is conducted in such a manner that the mass of ions passing through the quadrupole mass filter is sequentially changed.

In the quadrupole mass spectrometer according to the third aspect of the present invention, the control means relatively reduces the voltage ratio U/V of the direct current voltage U to the radio-frequency voltage V for a relatively large mass. Accordingly, line L depicted on the stability diagram during the mass scanning is not a straight line, but a curve line whose inclination is more gradual in a high mass region, as shown in FIG. 5. As a result, in the region where the mass is particularly high in the mass-scan range, the length of line L crossing across the stability region becomes longer, and the area enclosed by line L and the boundary line of the stability region becomes larger. In other words, the amount of ions passing through the quadrupole mass filter increases.

According to a fourth aspect of the present invention made for solving the above problems, a quadrupole mass spectrometer includes: an ion source for ionizing a sample molecule; a quadrupole mass filter selectively allowing an ion having a specific mass to pass therethrough among ions generated in the ion source; and a detector for detecting ions having passed through the quadrupole mass filter, the quadrupole mass spectrometer comprising: a) a quadrupole driving means for applying, to respective electrodes forming the quadrupole mass filter, a voltage obtained by adding a direct current voltage and a radio-frequency voltage; and b) a control means for controlling the quadrupole driving means to sequentially change the direct current voltage and an amplitude of the radio-frequency voltage depending on the mass, and to vary an offset of the direct current voltage depending on the mass, when a mass scanning is conducted in such a manner that the mass of ions passing through the quadrupole mass filter is sequentially changed.

In the quadrupole mass spectrometer according to the fourth aspect of the present invention, the control means relatively reduces the offset of the direct current voltage for a relatively large mass. Accordingly, line. L depicted in the stability diagram during the mass scanning is also a curved line having a more gradual inclination in the range where the mass is high, as shown in FIG. 5, like the case of the third aspect of the present invention.

It should be noted that, in the third and fourth aspects of the present invention, the voltage ratio U/V or the offset of the voltage U may be set constant during a single mass-scan cycle when the scanning rate is small and an influence of the amount of change in the applied voltage while a certain ion passes through the quadrupole mass filter does not substantially raise any problem.

In the quadrupole mass spectrometer according to the first and second aspects of the present invention, the accelerating voltage determining the kinetic energy of ions introduced into the quadrupole mass filter may be changed depending on the scanning, rate, in addition to the above-mentioned control of the applied voltage.

Similarly, in the quadrupole mass spectrometer according to the third and fourth aspects of the present invention, the accelerating voltage determining the kinetic energy of ions introduced into the quadrupole mass filter may be changed depending on the change in the mass of the ions during the mass scanning, in addition to the above-mentioned control of the applied voltage.

In a configuration having an ion transport optical system, such as an ion lens for transporting ions, between the ion source and the quadrupole mass filter, the above-mentioned accelerating voltage corresponds to a direct-current potential difference between the ion transport optical system and the quadrupole mass filter. Specifically, the larger the potential difference is, the larger the kinetic energy of ions introduced into the quadrupole mass filter is. This causes the time required for ions to pass through the quadrupole mass filter to be shorter. Accordingly, the influence of the change in the applied voltage is relatively diminished, allowing the target ions to more easily pass through the quadrupole mass filter.

Effect of the Invention

According to a quadrupole mass spectrometer according to any of the first through fourth aspects of the present invention, when the scanning rate is raised, the probability that target ions, in particular ions having high masses, pass through a quadrupole mass filter and arrive at a detector yet becomes high. Accordingly, detection sensitivity can be higher than ever before. Furthermore, by appropriately adjusting a voltage ratio U/V of the direct current voltage U to the radio-frequency voltage V or an offset of the direct current voltage U, the detection sensitivity can be kept approximately constant regardless of the scanning rate or mass during the mass scanning. As a result, a quantitative capability of the analysis can be improved.

EXPLANATION OF NUMERALS

1 . . . Ion Source
2 . . . Ion Transport Optical System
3 . . . Quadrupole Mass Filter
3*a*, 3*b*, 3*c*, 3*d* . . . Rod Electrodes
4 . . . Detector
C . . . Ion Beam Axis
10 . . . Control Unit
11 . . . Input Unit
12 . . . Voltage-Control Data Storage Unit
13 . . . Ion Selection Voltage Generator
15 . . . Radio-Frequency (RF) Voltage Generator
16 . . . Direct Current (DC) Voltage Generator
17 . . . Radio-Frequency/Direct Current (RF/DC) Adder
18 . . . Bias Voltage Generator
19, 20 . . . Bias Adder
21 . . . Ion Optical System Voltage Generator

BEST MODE FOR CARRYING OUT THE INVENTION

Figure 1:
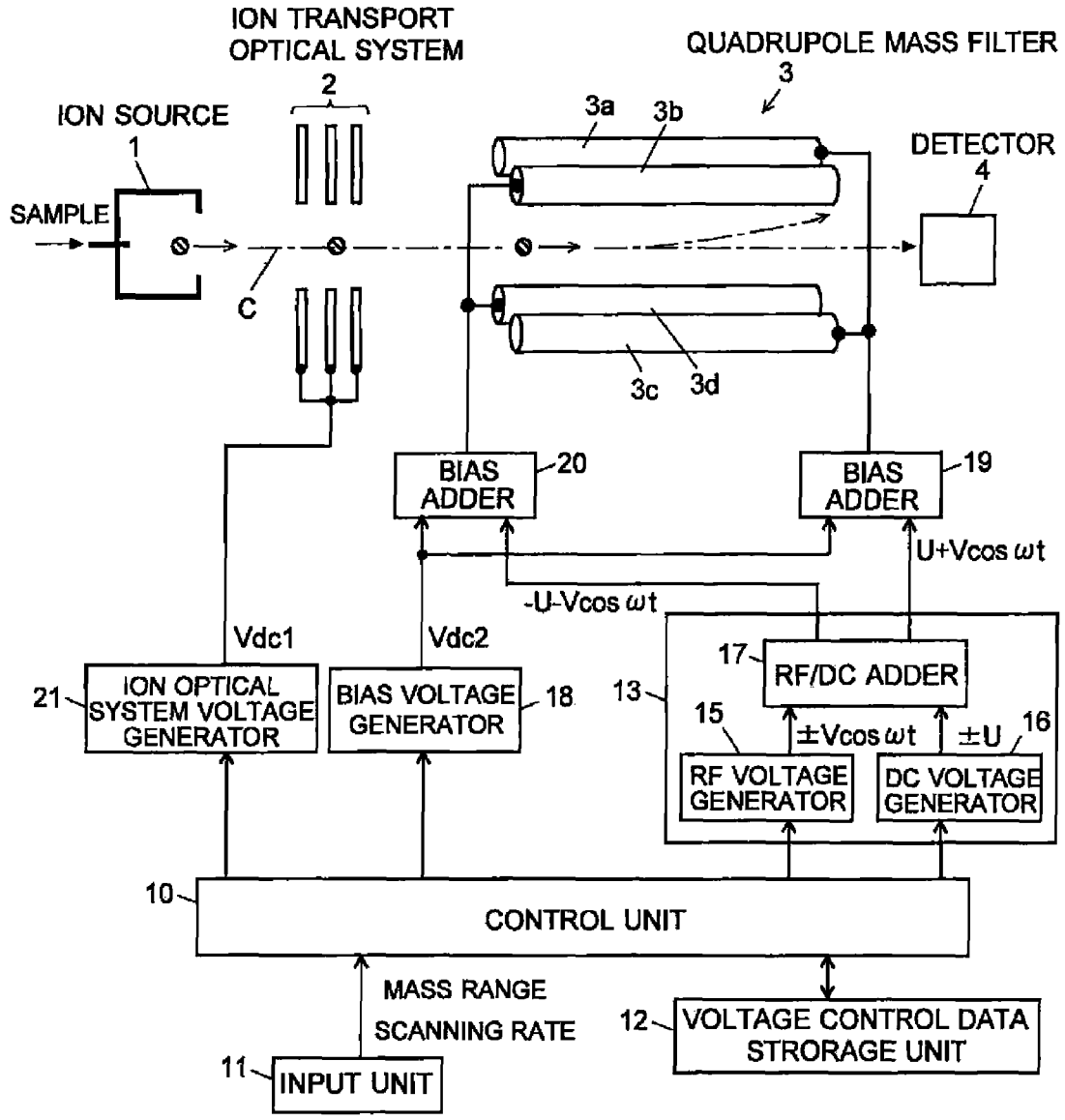
FIG. 1 is a configuration diagram showing main parts of a quadrupole mass spectrometer according to an embodiment of the present invention.
Figure 6:
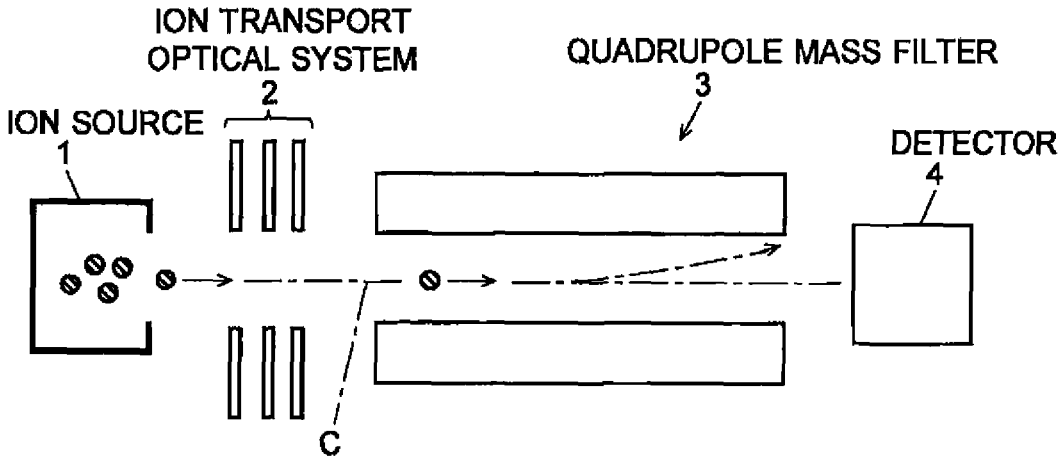
FIG. 6 is a schematic configuration diagram of a typical quadrupole mass spectrometer, mainly showing an ion optical system of the mass spectrometer.

A quadrupole mass spectrometer according to an embodiment of the present invention is described, referring to the attached drawings. FIG. 1 is a configuration diagram showing main parts of the quadrupole mass spectrometer according to the present embodiment. The same reference numerals are allotted to the same structural elements as those in already described in FIG. 6. The quadrupole mass spectrometer according to the present embodiment is so configured as to introduce a sample in the form of gas into an ion source 1, and a gas chromatograph can be connected in a previous stage of the mass spectrometer. When a configuration for analyzing a sample in the form of a liquid is adopted, an atmospheric pressure ion source, such as an electrospray ionization source, is used as the ion source 1, which is set at an atmosphere approximately at atmospheric pressure, and a multistage differential exhaust system is adopted in order to arrange a quadrupole mass filter 3 and a detector 4 in high vacuum atmosphere. In such case, a liquid chromatograph can be connected in a previous stage of the mass spectrometer.

In the quadrupole mass spectrometer according to the present embodiment, the ion source 1, an ion transport optical system 2, the quadrupole mass filter 3, and the detector 4 are arranged inside a vacuum chamber (not shown), as previously mentioned. The quadrupole mass filter 3 includes four rod electrodes 3*a*, 3*b*, 3*c*, and 3*d* disposed in such a manner that the four rod electrodes come into contact with an inner circumference of a cylinder having a center on an ion beam axis C and a predetermined radius. Among the four rod electrodes 3*a*, 3*b*, 3*c*, and 3*d*, two rod electrodes opposite to each other across the ion beam axis C, specifically, the rod electrodes 3*a* and 3*c* as well as the rod electrodes 3*b* and 3*d* are connected respectively. An ion selection voltage generator 13, a bias voltage generator 18, and bias adders 19, 20 respectively serve as a quadrupole driving means for applying voltage to the four rod electrodes 3*a*, 3*b*, 3*c*, and 3*d*. The ion selection voltage generator 13 includes a direct current (DC) voltage generator 16, radio-frequency (RF) voltage generator 15, and a radio-frequency/direct current (RF/DC) adder 17.

An ion optical system voltage generator 21 applies a direct current voltage Vdc1 to the ion transport optical system 2 which is in the previous stage of the quadrupole mass filter 3. A control unit 10 controls the operations of the ion optical system voltage generator 21, the ion selection voltage generator 13, the bias voltage generator 18, and the like. A voltage-control data storage unit 12 is connected to the control unit 10 for conducting the control. In addition, an input unit 11 to be operated by an operator is also connected to the control unit 10. The functions of the control unit 10 are implemented by a system mainly consisting of a computer including a CPU, memory and other components.

The DC voltage generator 16 is accommodated in the ion selection voltage generator 13 and generates direct current voltages of ±U having polarities different from each other under the control of the control unit 10. Similarly, the RF voltage generator 15 generates radio-frequency voltages of ±V·cos ωt having a phase difference of 180 degrees from each other under the control of the control unit 10. An RF/DC adder 17 adds up the direct current voltages±U and the radio-frequency voltages±V·cos ωt, and generates in two systems of voltages, U+V·cos ωt and −(U+V·cos ωt). These are the ion selection voltages that determine the mass (m/z in the precise sense) of ions passing through the quadrupole mass filter.

The bias voltage generator 18 generates a direct current bias voltage Vdc2 to be commonly applied to the respective rod electrodes 3*a* to 3*d* in such a manner that the voltage difference between the DC bias voltage Vdc2 and the DC voltage Vdc1 applied to the ion transport optical system 2 becomes appropriate, in order to form, in front of the quadrupole mass filter 3, a direct-current electrical field with which ions are efficiently introduced into a space in the longitudinal axis direction of the quadrupole mass filter 3. The bias adder 19 adds the ion selection voltage U+V·cos ωt and the DC bias voltage Vdc2 and applies the obtained voltage of Vdc2+U+V·cos ωt to the rod electrodes 3*a* and 3*c*, while the bias adder 20 adds the ion selection voltage−(U+V·cos ωt) and the DC bias voltage Vdc2 and applies the obtained voltage of Vdc2−(U+V·cos ωt) to the rod electrodes 3*b* and 3*d*.

Figure 2:
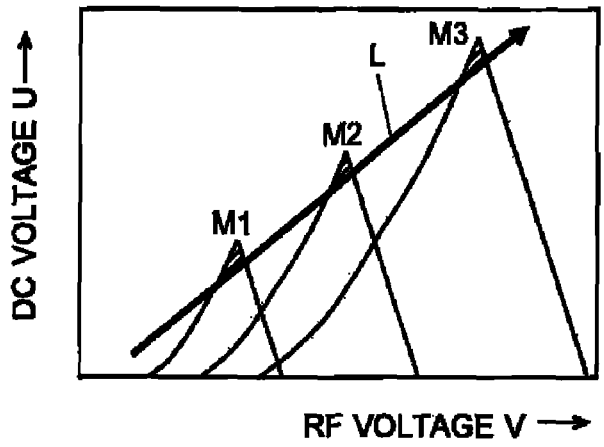
FIGS. 2(*a*) to 2(*c*) are stability diagrams for describing forms of change of applied voltages during a mass scanning.
Figure 2:
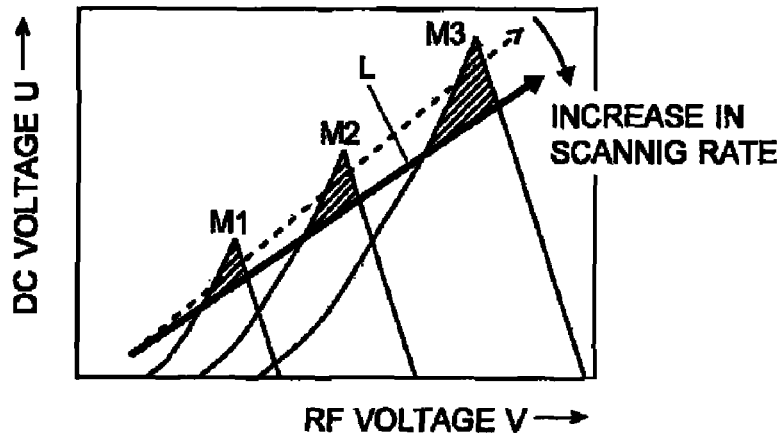
Figure 2:
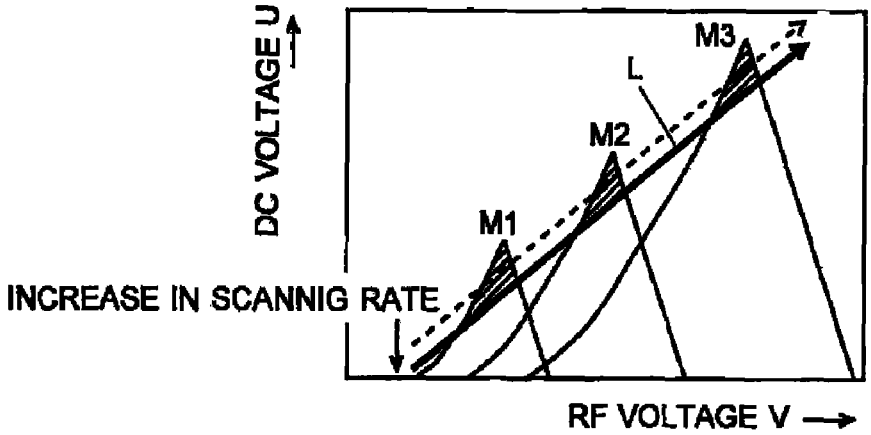

When such voltages as previously mentioned are applied to the respective rod electrodes 3*a* to 3*d* of the quadrupole mass filter 3, the behavior of ions existing in the space along the long axis of the quadrupole mass filter 3 can be indicated in a stability diagram based on a stability condition of a solution of the Mathieu equation, as previously mentioned. The stability diagram is, in a strict manner, a graph adopting "q" for the horizontal axis and "a", for the vertical axis, wherein "q" and "a" are obtained in the below shown equations. The stability diagrams in FIG. 2 are a simplified version, with the horizontal axis indicating V and the vertical axis indicating U. This simplification is based on the fact that the value "q" is proportional to the amplitude V of the radio-frequency voltage and the value "a" is proportional to the direct current voltage U.

$$q=(4e/mr^2\omega^2)V$$

$$a=(8e/mr^2\omega^2)U$$

In these equations, "m" is the mass of an ion (this means "mass" in the strict sense, but not m/z), and "r" is the radius of the inscribed circle of the rod electrodes 3*a* to 3*d*.

In this stability diagram, a region where an ion having a certain mass stably vibrates is the stability region having an approximately triangular shape. An outside of the stability region is an unstability region where ions are diffused.

Figure 7:
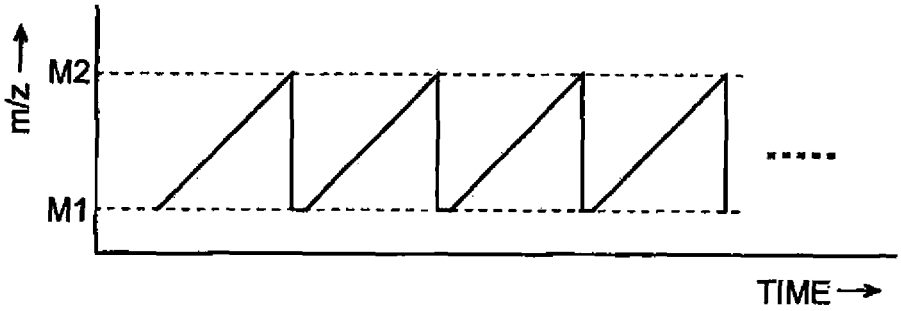
FIG. 7 is a diagram schematically showing a change in the mass of ions arriving at a detector during a repetitive scanning measurement.
Figure 8:
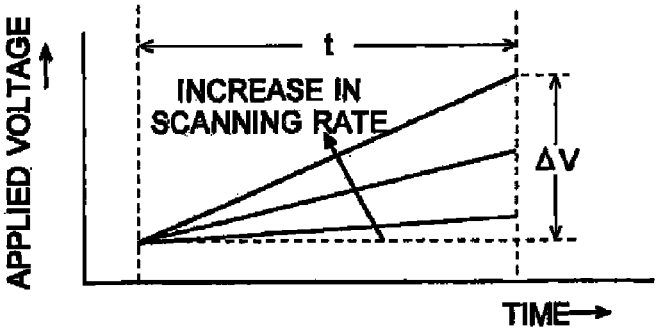
FIG. 8 is a graph showing a relationship between time and voltage applied to the quadrupole mass filter.
Figure 9:
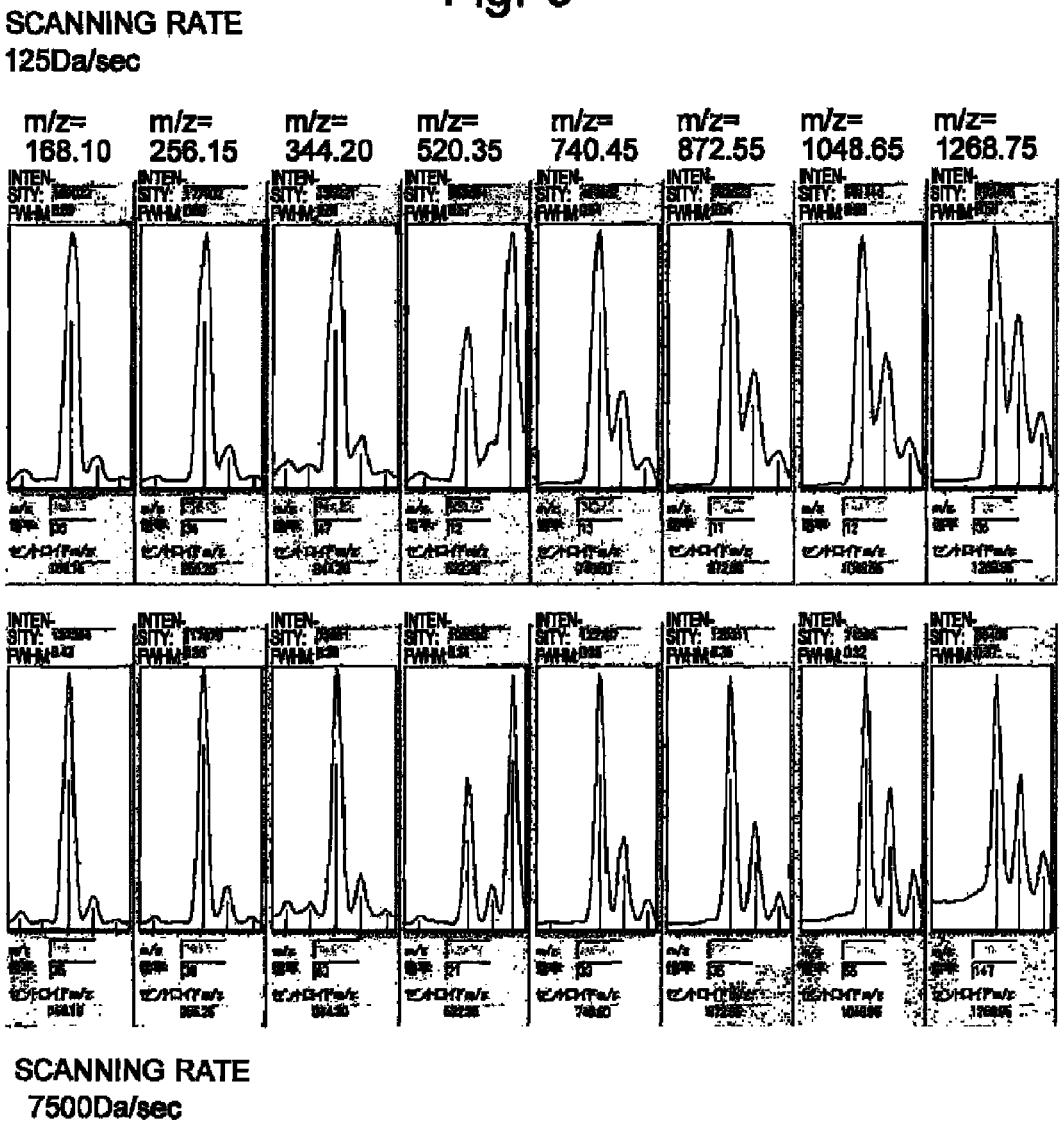
FIG. 9 is a diagram showing mass spectrums measured with a conventional quadrupole mass spectrometer.

When a scanning measurement is conducted, as shown in FIG. 7, a predetermined mass range is repeatedly scanned at a predetermined scanning rate. The mass range or the scanning rate is one of the analysis conditions, which should be set from the input unit 11 by an operator before the analysis. If the scanning rate is increased, a frequency of repeating the scanning per a predetermined time is increased, thereby raising time resolution. This decreases the possibility of missing a component introduced into the ion source 1 only for a short time. In addition, raising the time resolution increases the separation rate of a gas chromatograph (or a liquid chromatograph) connected to the previous stage of the mass spectrometer, thereby resulting in an improvement of the throughput. Accordingly, it is preferable that an appropriate scanning rate is set according to an object of the analysis or the kind of sample to be analyzed. For this purpose, in the quadrupole mass spectrometer according to the present embodiment, one of a plurality of previously prepared scanning rates can be selected by the input unit 11.

In a conventional quadrupole mass spectrometer, values of the voltages U and V appropriate for each mass are determined in advance under the condition that the voltage ratio U/V of the direct current voltage U to the amplitude V of the radio-frequency voltage during the mass scanning is kept constant, and control data obtained by digitalizing these voltages is stored in the voltage-control data storage unit 12. Although the amount of change in the voltages U and V with respect to a unit-time step width varies depending on the scanning rate, the respective values of the voltages U and V are determined in such a manner that the voltage ratio U/V is constantly the same value. On the other hand, in the quadrupole mass spectrometer according to the present embodiment, a different voltage ratio U/V is determined in advance for each scanning rate. In the scanning measurement in which the mass scanning is repeated at a certain scanning rate, each of voltages U and V changes according to the mass while the voltage ratio U/V determined for that scanning rate is maintained.

Figure 3:
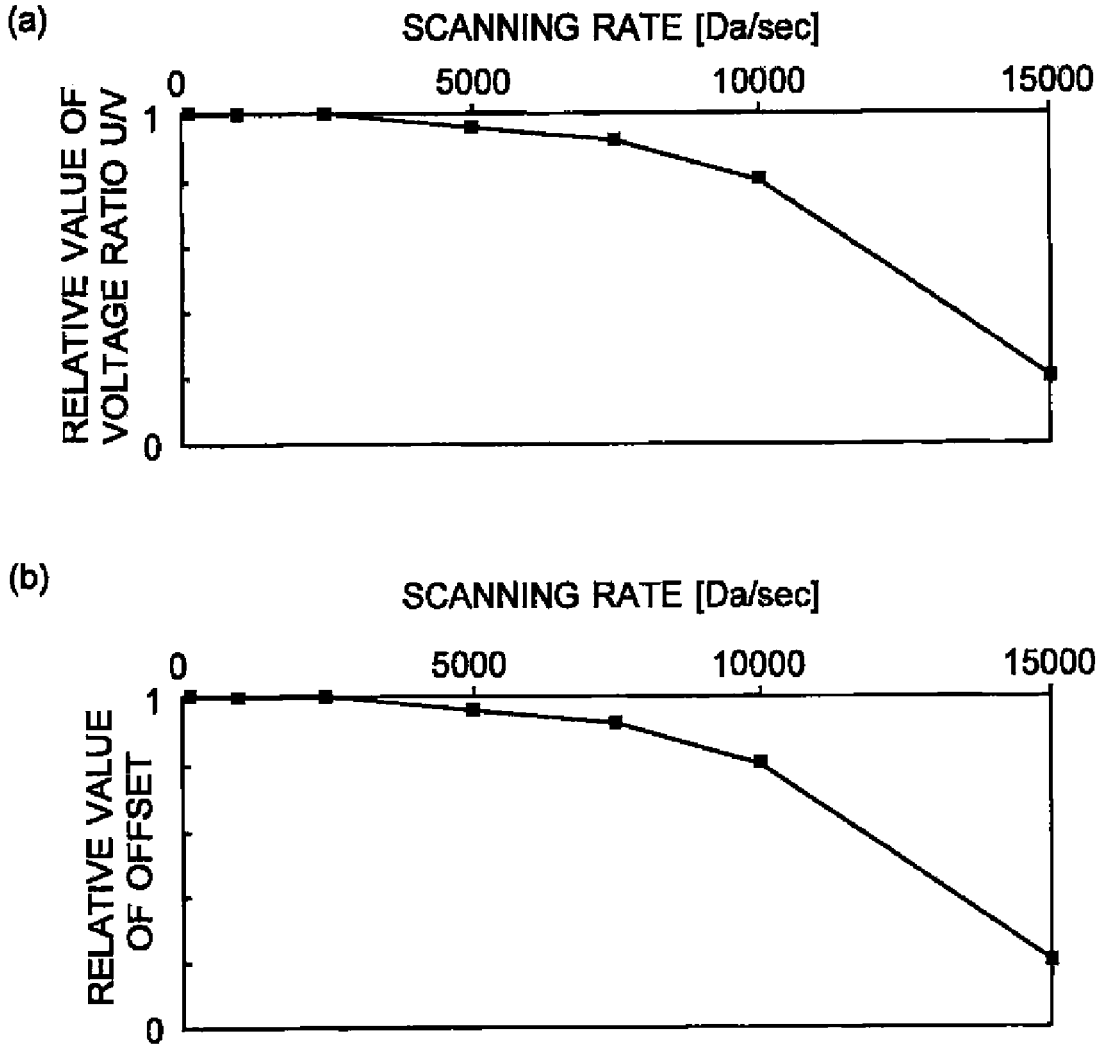
FIGS. 3(*a*) and 3(*b*) are graphs for describing a voltage controlling operation during the mass scanning.

The relationship between the scanning rate and the voltage ratio U/V is determined, for example, as shown in FIG. 3(*a*). Specifically, it is determined in such a manner that the higher the scanning rate is, the smaller the voltage ratio U/V is. In the stability diagram, as shown in FIG. 2(*b*), the inclination of line L indicating the changes in the voltages U and V during the mass scanning becomes moderate as the scanning rate is larger. In the stability region having an approximately triangular shape and corresponding to a single mass in the stability diagram, ions in a range shown with hatched lines in FIG. 2(*b*) can pass through the quadrupole mass filter 3 in theory. Therefore, the inclination of line L is made to be moderate as previously mentioned, increases the amount of ions passing through the quadrupole mass filter 3 in high mass. This secures high detection sensitivity even when the scanning rate is high.

Specifically, as previously described, the control data of the voltages U and V for each mass under the condition that the value of the voltage ratio U/V associated with the scanning rate is kept constant is stored in the voltage-control data storage unit 12. A manufacturer of the present apparatus can check the apparatus for the control data and store them in the storage unit 12 at an adjustment stage before a factory shipment. Upon conducting an analysis, the control unit 10 reads out, according to the mass change, the control data for keeping the value of the voltage ratio U/V corresponding to the scanning rate set through the input unit 11, and sends the data to the RF voltage generator 15 and the DC voltage generator 16. The RF voltage generator 15 and the DC voltage generator 16 each include a D/A converter for converting the control data to an analogue voltage and generate $\pm V \cdot \cos \omega t$ and $\pm U$ by using the D/A converter so as to change the voltages applied to the respective rod electrodes 3*a* to 3*d* of the quadrupole mass filter 3.

Furthermore, the quadrupole mass filter according to the present embodiment is configured so that, as the scanning rate is set higher, the amount of kinetic energy of the ions at a point of introduction into the quadrupole mass filter 3 becomes larger, in order to reduce the amount of change in the applied voltage during the ions' passing through the quadrupole mass filter 3 when the scanning rate is high. The aforementioned kinetic energy of the ions is determined according to a relationship among the DC bias voltages at the ion source 1, ion transport optical system 2, and quadrupole mass filter 3. Now, it is assumed that the direct current voltage of the ion source 1 and the direct current voltage Vdc1 applied to the ion transport optical system 2 are kept constant. In this case, the kinetic energy that ions have depends on the DC bias voltage Vdc2 generated in the bias voltage generator 18.

In view of these conditions, a set of control data is prepared in the voltage control data storage unit 12 in advance. These control data are such that the higher the scanning rate is, the larger the voltage difference|Vdc2−Vdc1| is between the DC bias voltage Vdc2 and the DC voltage Vdc1 applied to the ion transport optical system 2 which is in the previous stage. Upon conducting the analysis, the control unit IC reads out, from the storage unit 12, the control data corresponding to the scanning rate set through the input unit 11 and transmits the data to the bias voltage generator 18. The bias voltage generator 18 converts the control data to an analogue voltage value, and outputs this voltage as the bias voltage Vdc2. Accordingly, the higher the scanning rate is, the larger the amount of kinetic energy provided to ions before their introduction into the quadrupole mass filter 3 is. The larger the mount of kinetic energy that ions have at an entrance of the quadrupole mass filter 3 is, the higher the flying speed of the ions is. This shortens the time required for the ions to pass through a space in the longitudinal axis of the filter. As a result, the amount of change in the direct current voltage U and the amplitude V of the radio-frequency voltage, both voltages applied to the rod electrodes 3*a* to 3*d*, are relatively reduced, thereby improving the efficiency of the ions' passage.

In the previous embodiments, the voltage ratio U/V of the direct current voltage U to the radio-frequency voltage V applied to the rod electrodes 3*a* to 3*d* of the quadrupole mass filter 3, i.e., the inclination of line L in the stability diagram, is changed depending on the scanning rate, and the voltages U and V are changed in accordance with the change of the mass. However, line L may be shifted vertically (in the direction of the change of the direct current voltage U) according to the scanning rate without changing the inclination of line L in the stability diagram. In other words, the offset of line L may be reduced. Specifically, as shown in FIG. 2(*c*), line L may be shifted in the downward direction in the stability diagram, as the scanning rate becomes larger. The relationship between the scanning rate and the offset is determined, for example, as shown in FIG. 3(*b*). In this case, the voltage applied to the quadrupole mass filter 3 can be controlled as desired by storing, in the voltage-control data storing unit 12, a set of control data of the voltages U and V prepared for each mass under the condition that the voltage ratio U/V, with the offset of the direct current voltage U determined according to the scanning rate, is kept constant, similar to the previous embodiments.

At the time of the mass scanning, the larger the mass is, the larger an influence of the amount of change in the applied voltage during the ions' passing through the quadrupole mass filter 3 is (see FIG. 4(*b*), which will be described later). Accordingly, instead of changing the value of the voltage ratio U/V or the offset of the direct current voltage U according to the scanning rate, it is possible to reduce the voltage ratio U/V or the offset of the direct current voltage U as the mass becomes larger during the mass scanning. In this case, line L in the stability diagram is not a straight line but a curved line as shown in FIG. 5. Specifically, the voltages U and V are not respectively changed so that the voltage ratio U/V is constant during a single mass-scanning cycle, but respectively changed while the voltage ratio U/V is varied during a single mass-scanning cycle. It is clear that the control for varying the applied voltage in this mariner can be conducted similar to the previous embodiments.

Effects of improvements in detection sensitivity in the quadrupole mass spectrometer according to the present invention are hereinafter described based on a result of an experiment. FIG. 4(*a*) is a diagram showing a relationship between the scanning rate and a peak relative intensity in the quadrupole mass spectrometer of the present invention, while FIG. 4(*b*) is a diagram showing a relationship between the scanning rate and the peak relative intensity in a conventional quadrupole mass spectrometer. The result shown in FIG. 4(*a*) was obtained by changing both the voltage ratio U/V and the offset of the direct current voltage U depending on the scanning rate as shown in FIG. 3, and the ion accelerating voltage was maintained constant.

Figure 4:
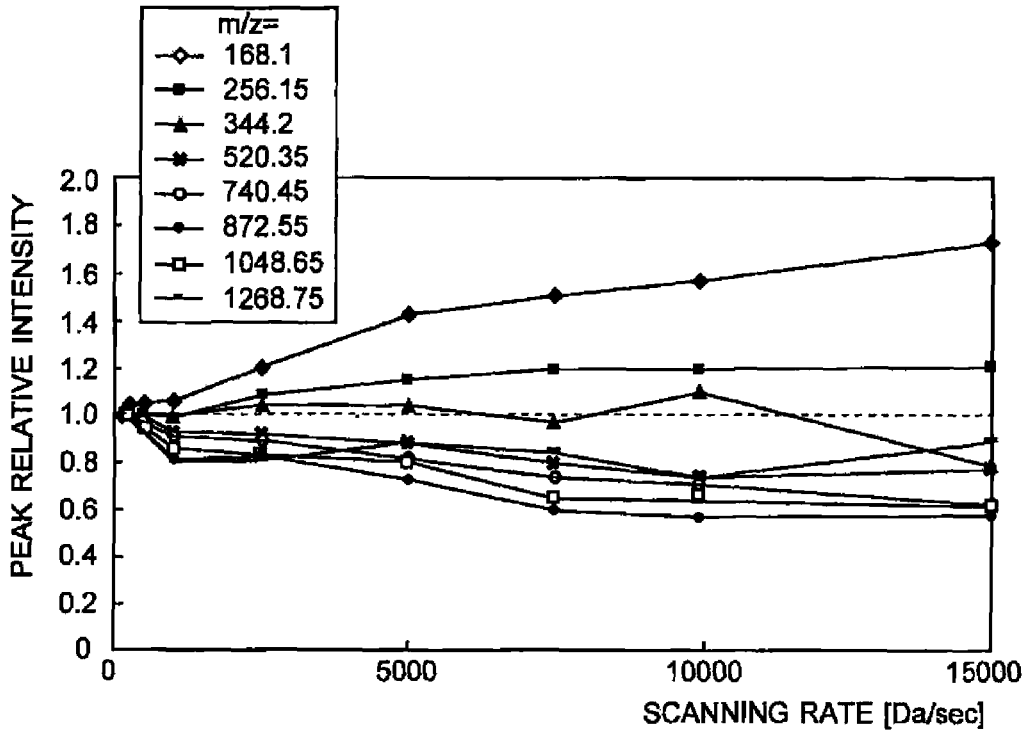
FIGS. 4(*a*) and 4(*b*) are graphs each showing an observation result for comparing efficiencies of ion's passage through a quadrupole mass filter.
Figure 4:
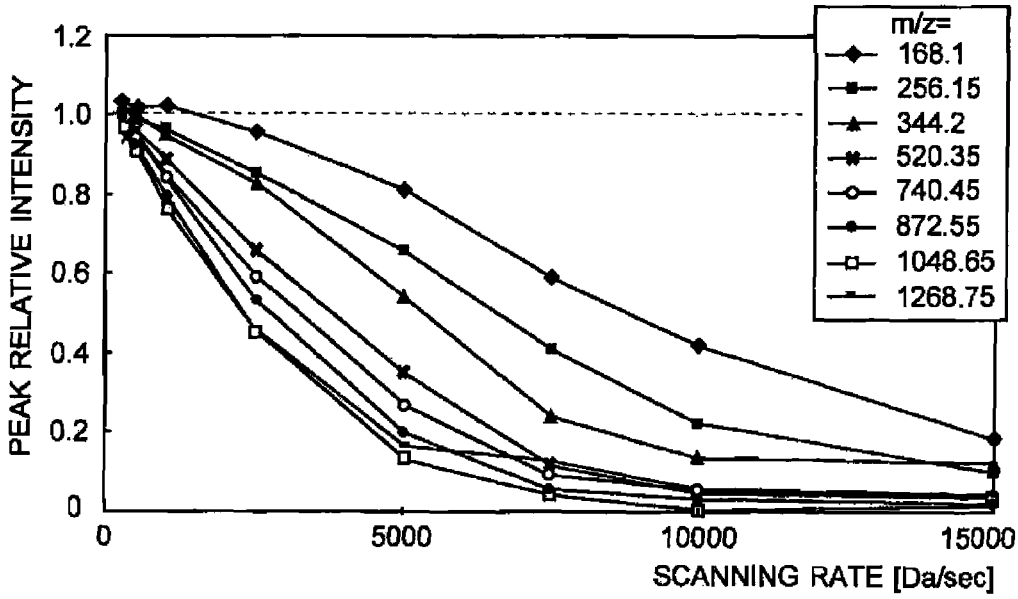
Figure 5:
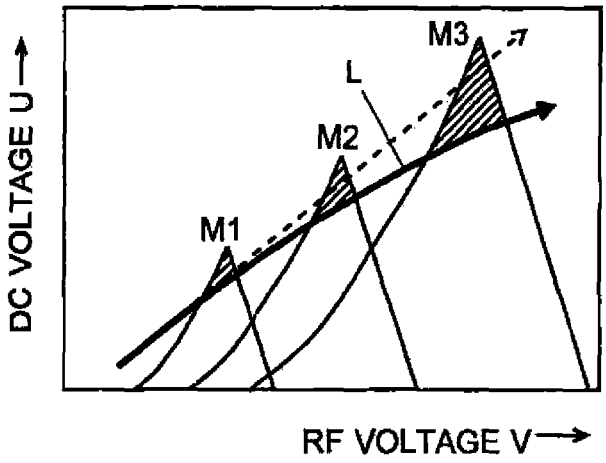
FIG. 5 is a stability diagram for describing forms of change of applied voltages during a mass scanning according to another embodiment of the present invention.

It can be understood from FIG. 4(*b*) that in the conventional quadrupole mass spectrometer, the peak relative intensity, i.e., the detection sensitivity, decreases remarkably, as the scanning rate becomes higher. The degree of the decrease is noteworthy as the mass becomes larger. In contrast, in the quadrupole mass spectrometer of the present invention, as shown in FIG. 4(*a*), the degree of the decrease in the peak relative intensity is dramatically small even when the scanning rate becomes higher. It shows that high detection sensitivity is achieved. As a result, the detection sensitivity can be kept approximately constant regardless of the scanning rate.

It should be noted that the previous embodiment is one example of the present invention, and clearly included in the scope of claims of the present application even if a change, addition or modification is appropriately made within the scope of the subject matter of the present invention.

The invention claimed is:

1. A quadrupole mass spectrometer including:

an ion source for ionizing a sample molecule;

a quadrupole mass filter selectively allowing an ion having a specific mass to pass therethrough among ions generated in the ion source; and a detector for detecting ions having passed through the quadrupole mass filter, the quadrupole mass spectrometer comprising:

a) a quadrupole driving means for applying, to respective electrodes forming the quadrupole mass filter, a voltage obtained by adding a direct current voltage and a radio-frequency voltage; and b) a control means for controlling the quadrupole driving means to sequentially change the direct current voltage and an amplitude of the radio-frequency voltage depending on the mass, and to change a ratio of the direct-current voltage to the amplitude of the radio-frequency voltage depending on a scanning rate so that the ratio UN of the direct current voltage U and the amplitude V of the radio-frequency voltage is relatively reduced for a relatively high scanning rate, when a mass scanning is conducted in such a manner that the mass of ions passing through the quadrupole mass filter is sequentially changed.

2. The quadrupole mass spectrometer according to claim 1, wherein an accelerating voltage determining a kinetic energy of ions introduced into the quadrupole mass filter is changed depending on the scanning rate.

3. The quadrupole mass spectrometer according to claim 2, further comprising an ion transport optical system for transporting ions between the ion source and the quadrupole mass filter, wherein the accelerating voltage is a direct-current potential difference between the ion transport optical system and the quadrupole mass filter.

4. A quadrupole mass spectrometer including:

an ion source for ionizing a sample molecule;

a quadrupole mass filter selectively allowing an ion having a specific mass to pass therethrough among ions generated in the ion source; and a detector for detecting ions having passed through the quadrupole mass filter, the quadrupole mass spectrometer comprising:

a) a quadrupole driving means for applying, to respective electrodes forming the quadrupole mass filter, a voltage obtained by adding a direct current voltage and a radio-frequency voltage; and b) a control means for controlling the quadrupole driving means to sequentially change the direct current voltage and an amplitude of the radio-frequency voltage depending on the mass, and simultaneously, to change a ratio of the direct current voltage to an amplitude of the radio-frequency voltage depending on the mass, when a mass scanning is conducted in such a manner that the mass of ions passing through the quadrupole mass filter is sequentially changed.

5. The quadrupole mass spectrometer according to claim 4, wherein an accelerating voltage determining a kinetic energy of ions introduced into the quadrupole mass filter is changed depending on the scanning rate.

6. The quadrupole mass spectrometer according to claim 5, further comprising an ion transport optical system for transporting ions between the ion source and the quadrupole mass filter, wherein the accelerating voltage is a direct-current potential difference between the ion transport optical system and the quadrupole mass filter.

7. A quadrupole mass spectrometer including:

an ion source for ionizing a sample molecule;

a quadrupole mass filter selectively allowing an ion having a specific mass to pass therethrough among ions generated in the ion source; and a detector for detecting ions having passed through the quadrupole mass filter; the quadrupole mass spectrometer comprising:

a) a quadrupole driving means for applying, to respective electrodes forming the quadrupole mass filter, a voltage obtained by adding a direct current voltage and a radio-frequency voltage; and b) a control means for controlling the quadrupole driving means to sequentially change the direct current voltage and an amplitude of the radio-frequency voltage depending on the mass, and to change an offset of the direct-current voltage depending on a scanning rate so that the offset of the direct current voltage is relatively reduced for a relatively high scanning rate, when a mass scanning is conducted in such a manner that the mass of ions passing through the quadrupole mass filter is sequentially changed.

8. The quadrupole mass spectrometer according to claim 7, wherein the control means relatively reduces the ratio UN of the direct current voltage U to the amplitude V of the radio-frequency voltage for a relatively large mass.

9. The quadrupole mass spectrometer according to claim 7, wherein an accelerating voltage determining a kinetic energy of ions introduced into the quadrupole mass filter is changed depending on a change in the mass of the ions during the mass scanning.

10. The quadrupole mass spectrometer according to claim 9, further comprising an ion transport optical system for transporting ions between the ion source and the quadrupole mass filter, wherein the accelerating voltage is a direct-current potential difference between the ion transport optical system and the quadrupole mass filter.

11. A quadrupole mass spectrometer including:

an ion source for ionizing a sample molecule;

a quadrupole mass filter selectively allowing an ion having a specific mass to pass therethrough among ions generated in the ion source; and a detector for detecting ions having passed through the quadrupole mass filter, the quadrupole mass spectrometer comprising:

a) a quadrupole driving means for applying, to respective electrodes forming the quadrupole mass filter, a voltage obtained by adding a direct current voltage and a radio-frequency voltage; and b) a control means for controlling the quadrupole driving means to sequentially change the direct current voltage and an amplitude of the radio-frequency voltage depending on the mass, and simultaneously, to change an offset of the direct current voltage depending on the mass, when a mass scanning is conducted in such a manner that the mass of ions passing through the quadrupole mass filter is sequentially changed.

12. The quadrupole mass spectrometer according to claim 11, wherein the control means relatively reduces the offset of the direct current voltage for a relatively large mass.

13. The quadrupole mass spectrometer according to claim 11 wherein an accelerating voltage determining a kinetic energy of ions introduced into the quadrupole mass filter is changed depending on a change in the mass of the ions during the mass scanning.

14. The quadrupole mass spectrometer according to claim 13, further comprising an ion transport optical system for transporting ions between the ion source and the quadrupole mass filter, wherein the accelerating voltage is a direct-current potential difference between the ion transport optical system and the quadrupole mass filter.

* * * * *